US005592790A

United States Patent [19]

Requejo

[11] Patent Number: 5,592,790

[45] Date of Patent: Jan. 14, 1997

[54] REINFORCED AWNING

[76] Inventor: Antonio Requejo, 13280 NW. 43 Ave., Opalocka, Fla. 33054

[21] Appl. No.: 383,406

[22] Filed: Feb. 3, 1995

[51] Int. Cl.[6] ..... E04B 1/34

[52] U.S. Cl. ..... 52/77; 52/202

[58] Field of Search ..... 52/74–77, 73, 52/202

[56] References Cited

U.S. PATENT DOCUMENTS

| | | | |
|---|---|---|---|
| 2,629,904 | 3/1953 | Bristow | 52/77 |
| 2,834,072 | 5/1958 | Miller | 52/77 |
| 3,300,941 | 1/1967 | Heirich | 52/74 |
| 3,863,415 | 2/1975 | Bott | 52/77 X |

FOREIGN PATENT DOCUMENTS

| | | | |
|---|---|---|---|
| 731398 | 6/1955 | United Kingdom | 52/77 |

*Primary Examiner*—Carl D. Friedman
*Assistant Examiner*—Yvonne Horton-Richardson
*Attorney, Agent, or Firm*—J. Sanchelima

[57] ABSTRACT

An improvement for awning intended to withstand wind storms. A shoot member is mounted on the purlins that are included in a conventional awning, thereby defining space between the slats and the sheet member. Puncturing of the outer cover will not destroy the effectiveness of the awning since flying small particles still have the sheet member obstruction to their travel. Angular members are used as reinforcement to the structural integrity of the awning.

5 Claims, 2 Drawing Sheets

REINFORCED AWNING

BACKGROUND OF THE INVENTION

1. Field of the Invention

The present invention relates to aluminum awnings, and more particularly, to reinforced aluminum awnings to protect building openings from damage associated with wind storms.

2. Description of the Related Art

A number of awning designs have been created and used in the past. However, none of these designs include a protection structure for these awnings after being punctured by flying objects. The designs presently available lack any kind of reinforcement against severe impact by flying object at great speeds and protection after impact against small particles that can penetrate through openings punched on the awning by other flying objects. Typically a flying object punctures an awning and afterwards small flying particles find their way inside the dwelling being protected. With the added sheet member the flying small particles will still be kept out. None of the designs used or invented to this date have this improvement.

SUMMARY OF THE INVENTION

It is one of the main objects of the present invention to provide an impact resistant protective awning of building openings, with a backup shield incase exterior surface of awning is punctured.

It is another object of this invention to provide a device that permits an additional protection to openings, such as windows, against gravel, or any other flying particles, which are blown by strong wind storms, after the awning has sustained damage through severe impact from flying objects.

It is still another object of the present invention to provide a device that includes a filling foam which permits the shutter to be thermally and acoustically isolated.

It is yet another object of this invention to provide such a device that is inexpensive to manufacture, easy to secure in case of storms, requires no maintenance while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
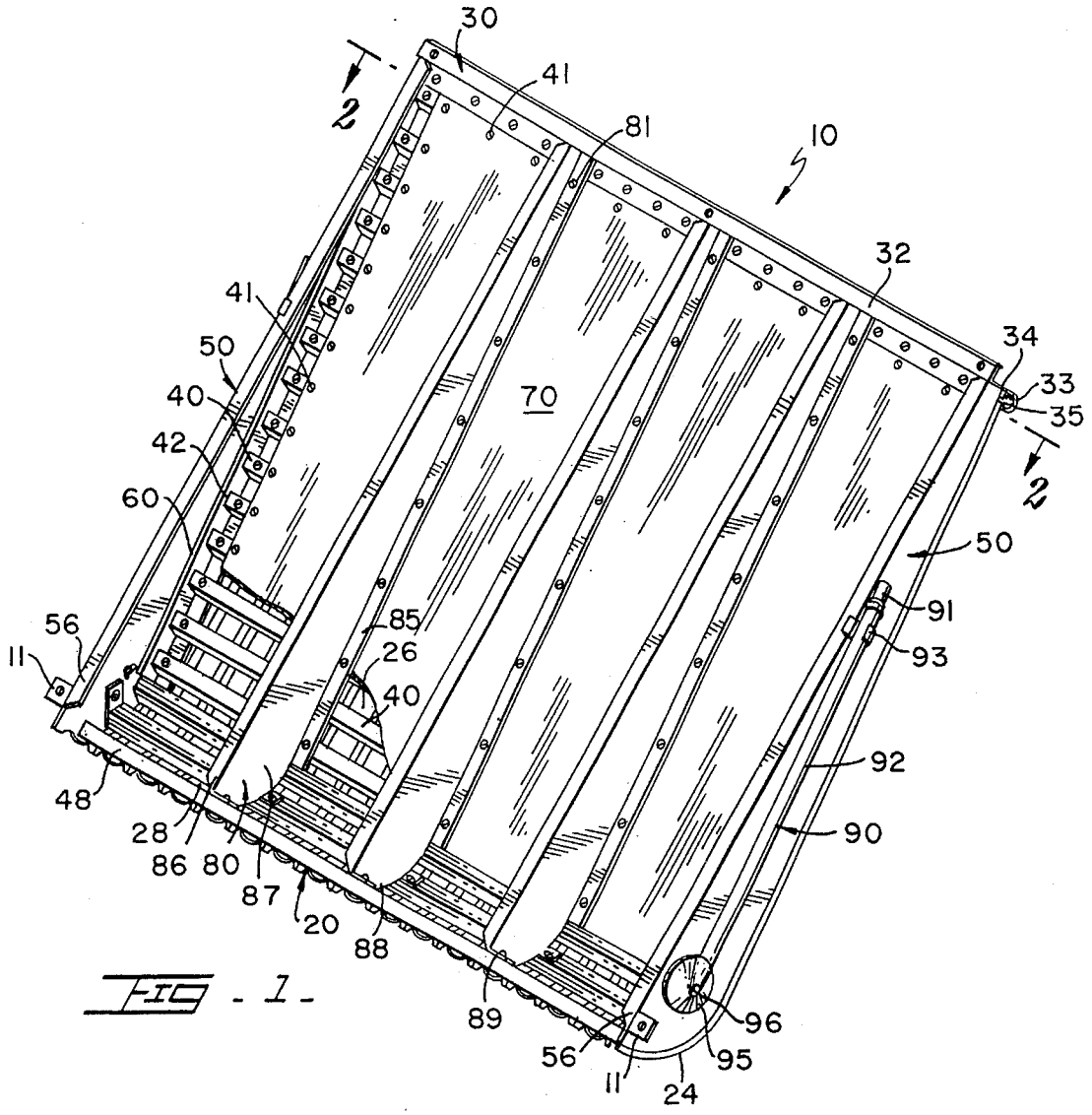
FIG. 1 is an isometric view from the bottom of an awning incorporating the teachings of the present invention.

Referring now to the drawings, where the present invention is generally referred to with numeral 10, it can be observed that it basically includes outer cover assembly 20 composed of several superimposed elongated and curved slats 22. Slats 22 are mounted to hinge assembly 30, purlin members 40, side stiffener members 50 and two elongated angular members 60. Protective sheet 70 is sandwiched between purlin members 40 and inner stiffener members 80. Protective sheet 70 can be implemented with any rigid material.

Figure 2:
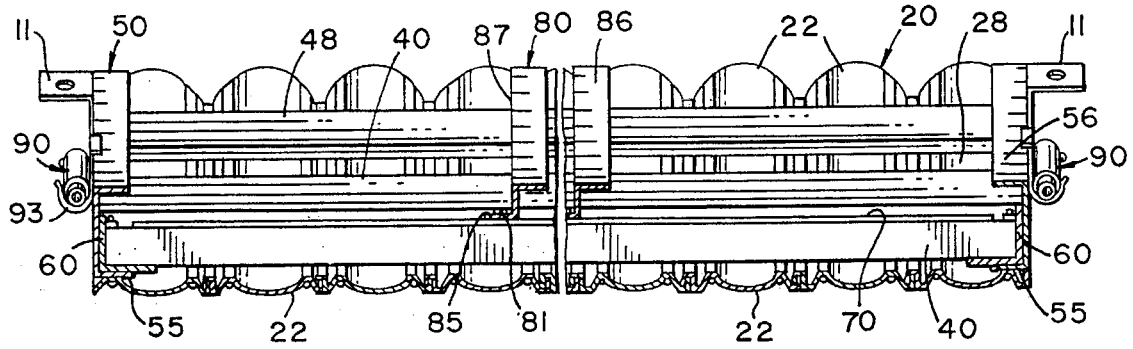
FIG. 2 is a cross-section taken along line 2—2 in FIG. 1.

As is shown in FIGS. 1 and 2, cover assembly 20 is formed by superimposing the longitudinal sides of elongated and curved slats 22. Slats 22 are straight except at their ends where they are curved. The inner surface of cover assembly 20 defines a flat portion 26 and a concave portion 28. Protective sheet 70 extends substantially along the entire flat portion 26. The sides of protective sheet 70 include holes through which screws 41 pass fastening sheet 70 to purlin members 40.

Purlin members 40 are preferably in a spaced apart and parallel relationship to each other, as best seen in FIGS. 1 and 2. In the preferred embodiment, members 40 are tubular members with a square cross-section in order to minimize the weight of the structure. Ends 42 of purlin members 40 are mounted to elongated angular members 60. Angular members 60 are sandwiched between purlin members 40 and upper flange 55 of side stiffener 50, as best seen in FIG. 2.

Upper flange 55 of side stiffener member 50 extends along the entire flat portion 26 of cover assembly 20. Lower flange 56 extends along the flat and curved portions 26 and 28, at an angle with respect to upper flange 55. Inner stiffener members 80 are mounted in a spaced apart and parallel relationship to each other and also with respect to side stiffener members 50. Inner stiffener members 80 include upper flange 85 and lower flange 86, that extend perpendicularly at the ends of central wall 87. In the preferred embodiment, as shown in FIGS. 1 and 2, upper and lower flange members 85 and 86 extend from central wall 87 in opposite directions.

Lower flange 86 along with purlin members 40 sandwich protective sheet 70 along its inner areas. Screws 81 fasten sheet 70 to purlin members 40 and upper flange 85. Central wall 87 includes front end 88 that has ear tab 89 with an opening. Tab 89 extends perpendicularly to central wall 87 and comes in abutment with front purlin member 48 which is mounted to the curved end of slats 22.

Hinge assembly 30 includes elongated leaf members 32 and 34. Leaf members 32 and 34 are joined to each other at their respective longitudinal ends, thereby forming a longitudinal angular member. Terminations 33 and 35 are partial tubular members that are coaxially housed within each other to provide the hinge function, as is illustrated in FIG. 1.

Figure 3:
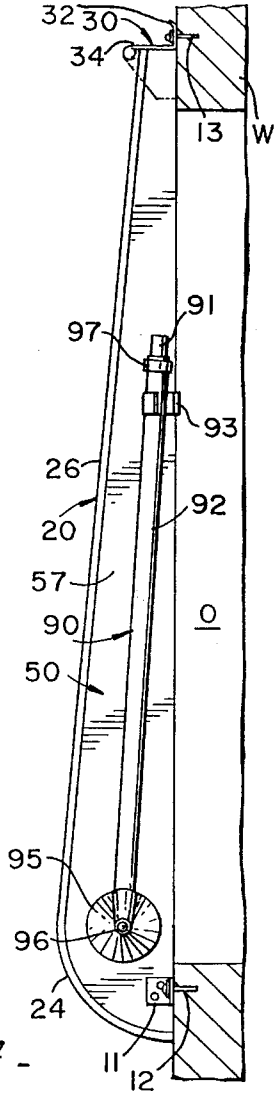
FIG. 3 illustrates a top view of the awning represented in FIG. 1.
Figure 4:
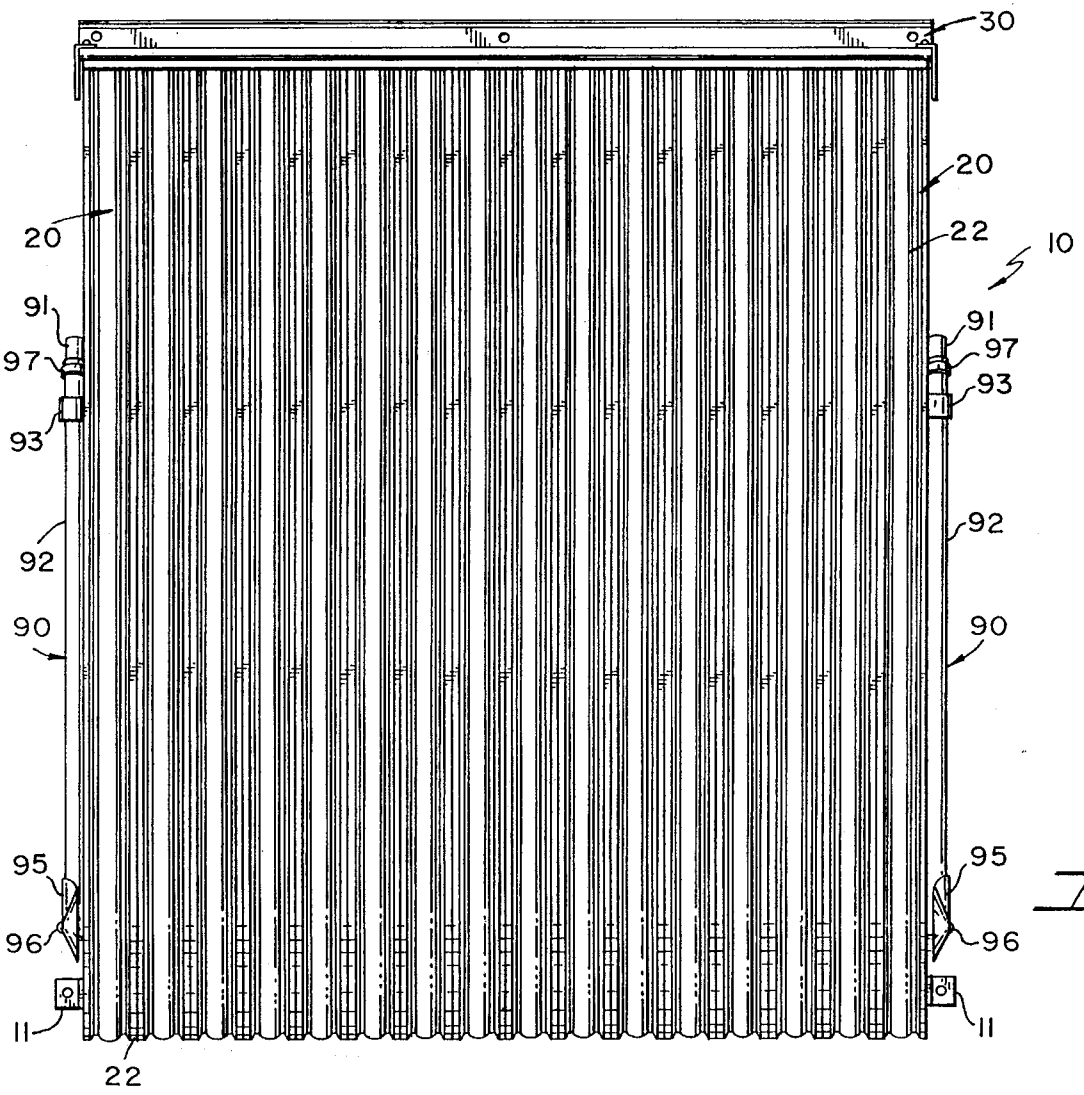
FIG. 4 is a side view of the awning protecting a window.

Telescopic assembly 90, in the preferred embodiment, is mounted to the outer wall of stiffener member 50. Telescopic assembly 90 comprises inner and outer tubular members 91 and 92 telescopically mounted within to each other. Outer tubular member 92 is, at the one end, mounted to side stiffener member 50 by pivoting pin 96 and cover 95. The other end of outer tubular member 92 is substantially mounted to hook member 93. Inner tubular member 91, in the present embodiment, is housed within outer tubular member 92 and is kept in this position by bracket member 97, as best seen in FIGS. 3 and 4.

Awning 10 is mounted to wall W protecting opening O by the use of screws 12 and 13. Bracket member 11 is rigidly mounted to outer surface of wall 57 of side stiffener member 50 and permits to mount awning 10 to wall W by screw member 12. Leaf member 32 has an opening through which screw 13 passes to mount the upper part of awning 10 to wall W.

The space between cover assembly 20 and purlin members 40 can be filled with thermal and/or acoustic insulating material, such as foam, cork or the like.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. In an aluminium awning mounted above a building opening to be protected and said aluminium awning being of the type that includes a plurality of partially superimposed elongated slats, having first and second ends, and said slats forming a cover assembly defining rear, front and lateral sides, the slats bring mounted on a plurality of spaced apart and parallel purlin members, hinge means with first and second leaf members and said first leaf member being mounted to said first ends of said slats which are aligned and define said rear side, and the other leaf member adapted to be mounted above said opening, and said awning further including two side stiffener members, having an upper and a lower flange each, and said lateral sides of said cover assembly being mounted to upper flanges, the improvement comprising a sheet member mounted on said purlin members at a spaced apart and parallel relationship with respect to said elongated slats.

2. The improvement set forth in claim 1 wherein said sheet member substantially covers said purlin members.

3. The improvement set forth in claim 2 further including elongated angular means sandwiched between said upper flanges of said side stiffener members and said purlin members.

4. The improvement set forth in claim 3 wherein the space between said sheet member and said elongated slags being filled with an acoustic insulator.

5. The improvement set forth in claim 3 wherein the space between said sheet member and said elongated slats being filled with a thermal insulator.

* * * * *